US009429287B2

(12) United States Patent
Ho

(10) Patent No.: US 9,429,287 B2
(45) **Date of Patent: *Aug. 30, 2016**

(54) LIGHTING DISPLAY DEVICE

(71) Applicant: Su-Fang Ho, New Taipei (TW)

(72) Inventor: Su-Fang Ho, New Taipei (TW)

( * ) Notice: Subject to any disclaimer, the term of this patent is extended or adjusted under 35 U.S.C. 154(b) by 80 days.

This patent is subject to a terminal disclaimer.

(21) Appl. No.: 14/488,500

(22) Filed: Sep. 17, 2014

(65) Prior Publication Data

US 2015/0003046 A1 Jan. 1, 2015

Related U.S. Application Data

(63) Continuation-in-part of application No. 13/535,559, filed on Jun. 28, 2012, now Pat. No. 8,911,101.

(51) Int. Cl.

| | |
|---|---|
| ***F21V 33/00*** | (2006.01) |
| ***F21S 10/00*** | (2006.01) |
| ***F21V 9/12*** | (2006.01) |
| ***G09F 13/24*** | (2006.01) |
| *F21V 13/02* | (2006.01) |
| *F21W 121/00* | (2006.01) |
| *F21Y 101/02* | (2006.01) |
| *F21S 6/00* | (2006.01) |

(52) U.S. Cl.

CPC ..... *F21S 10/002* (2013.01); *F21V 9/12* (2013.01); *G09F 13/24* (2013.01); *F21S 6/002* (2013.01); *F21V 13/02* (2013.01); *F21W 2121/00* (2013.01); *F21Y 2101/02* (2013.01)

(58) Field of Classification Search

CPC ..... F21S 10/002; F21V 9/12; G06F 13/24

See application file for complete search history.

(56) References Cited

U.S. PATENT DOCUMENTS

| | | | | |
|---|---|---|---|---|
| 2,731,747 A * | 1/1956 | Hazelroth | G09F 13/24 | 40/406 |
| 3,531,635 A * | 9/1970 | Hancock | F21S 10/002 | 362/101 |
| 2004/0075996 A1* | 4/2004 | Lee | F21S 13/12 | 362/101 |

* cited by examiner

*Primary Examiner* — Peggy Neils
*Assistant Examiner* — Alexander Garlen
(74) *Attorney, Agent, or Firm* — Rosenberg, Klein & Lee

(57) ABSTRACT

A wide-angle lighting display and projection device with the features of its original patent application, and further has the bottom of a transparent bottle to be able to be fixed on a positioning hole by spinning, displaying an unlimited extension of an inward serial arrangement of a transparent bottle from the middle with a wider area of visual effects. Also, the transparent bottle thereof is easy for assembling and maintaining.

8 Claims, 9 Drawing Sheets

LIGHTING DISPLAY DEVICE

This patent application is a continuation-in-part of Ser. No. 13/535,559 filed on Jun. 28, 2012, currently pending.

BACKGROUND OF THE INVENTION

1. Field of the Invention

The present invention relates to a lighting display device, particularly to one that not only has features of the original patent application but can further display a wider area and has the transparent bottle thereof to be fixed inside the positioning hole thereof by spinning.

2. Description of the Related Art

A lava lamp display device disclosed in U.S. Pat. No. 3,570,156 comprises a glass vessel having a bottom arranged in a hollow conical metallic seating and located on an electric light bulb. Moreover, the glass vessel has two immiscible components, for example, liquid and paraffin which has a high density than the liquid at room temperature and a lower density than the liquid after heating. After the electric light bulb is turned on, the paraffin at the bottom of the glass vessel is heated and flows in the liquid. At the same time, the electric light bulb projects the light to the glass vessel, forming a lighting effect which becomes a decoration at homes and offices. In addition, if a plurality of glitters are put together with the liquid, the glitters would move and flow with the liquid; such application is called a glitter lamp. However, the lava lamp display device or the glitter lamp only has lighting effects in a single glass vessel. As a decoration, it seems to be monotonous and lacking of visual effects.

Also, the lava lamp display device and the glitter lamp are both decorations with lighting and water-flow changes inside a single transparent bottle only, which seem to be monotonous and lacking of visual effects as decorations; in other words, there is still room for improvement in these devices. To improve the invention from the prior art, the mentioned original US Patent application disclosed a permeable vision window in the middle of the front side of the frame to displace the lighting object which forms an unlimited extension of an inward serial arrangement from the middle when the non-parallel reflection surfaces are reflected repeatedly, making the invention as a lamp and decoration with special visual effects. However, the vision window is only a small area at the front side of the lamp, leaving the invention to be improved as well.

SUMMARY OF THE INVENTION

A primary object of the present invention is to provide a lighting display device that has features of the original application, displaying an unlimited extension of an inward serial arrangement of a transparent bottle of the lighting object in the middle when the non-parallel reflection surfaces are reflected repeatedly, and further widens the visual angle and visual area as well.

Another object of the present invention is to provide a lighting display device that is easy for assembling and maintaining.

To achieve the objects mentioned above, the present invention comprises a frame including a base on which a front frame body and a rear frame body are arranged; a film-coated glass mounted on the front frame body and having the front side with light transmittancy facing towards the front frame body as a window surface and the back side with reflectivity; a mounting seat arranged on the base, between the front frame body and the rear frame body with a positioning hole arranged thereon, on the inner periphery of which at least one positioning protrusion is arranged; a projecting device including at least one projecting light disposed in an engaging room under the positioning hole of the mounting seat with a projecting light source thereof aiming at the positioning hole; a support bracket with the lower end thereof arranged on the base of the frame and a lighting source arranged on the upper end thereof; a transparent bottle with the bottom thereof being able to be fixed on the positioning hole of the mounting seat by spinning and located above the projecting device, corresponding to the height of the window surface; a first reflection mirror and a second reflection mirror fixed on the rear frame body, located behind the transparent bottle and having the reflection surfaces thereof facing forward, and a center thereof serving as a reference to define the first and second reflection mirrors symmetrically, inclined to form an angle θ between 145° and 175°, so that the window surface would display an unlimited extension of an inward serial arrangement from the middle after the contents of the transparent bottle are reflected repeatedly and cumulatively by the first and second reflection mirrors; and a cover plate disposed on the rear frame body, behind the first and second reflection mirrors.

In an applicable embodiment, the first and second mirrors behind the rear frame body form an angle θ and have two symmetrical inclined surfaces to form a pre-determined slope when they are joined together. Additionally, the projecting device further includes a lamp base for the projecting light to be disposed thereon, and the projecting light can be a LED light or a bulb. Further, when the projecting light is a LED light, the bottom of the transparent bottle has contact with the top of the LED light where a heat conductive paster is arranged thereon in order to conduct the heat to the transparent bottle. Besides, the base has a power supply disposed inside and connected to the projecting device to supply the electric power for the device.

In an applicable embodiment, the transparent bottle can be a lava lamp or a glitter lamp.

In a preferred embodiment, the bottom of the transparent bottle has at least one thread on its periphery for the positioning protrusion of the positioning hole to be fixed thereon by spinning.

In a preferred embodiment, the support bracket is arranged in an L shape and is hollow for the power supply to connect to an electric wire through which to supply the electric power for the lighting source on which a lampshade is covering.

As structures disclosed above, the present invention not only has a window surface to enlarge the area of the unlimited extension of an inward serial arrangement of the transparent bottle from the middle, but can further display a wider area of visual effects. Also, the transparent bottle thereof is easy for assembling and maintaining.

DETAILED DESCRIPTION OF THE PREFERRED EMBODIMENT

Figure 1:
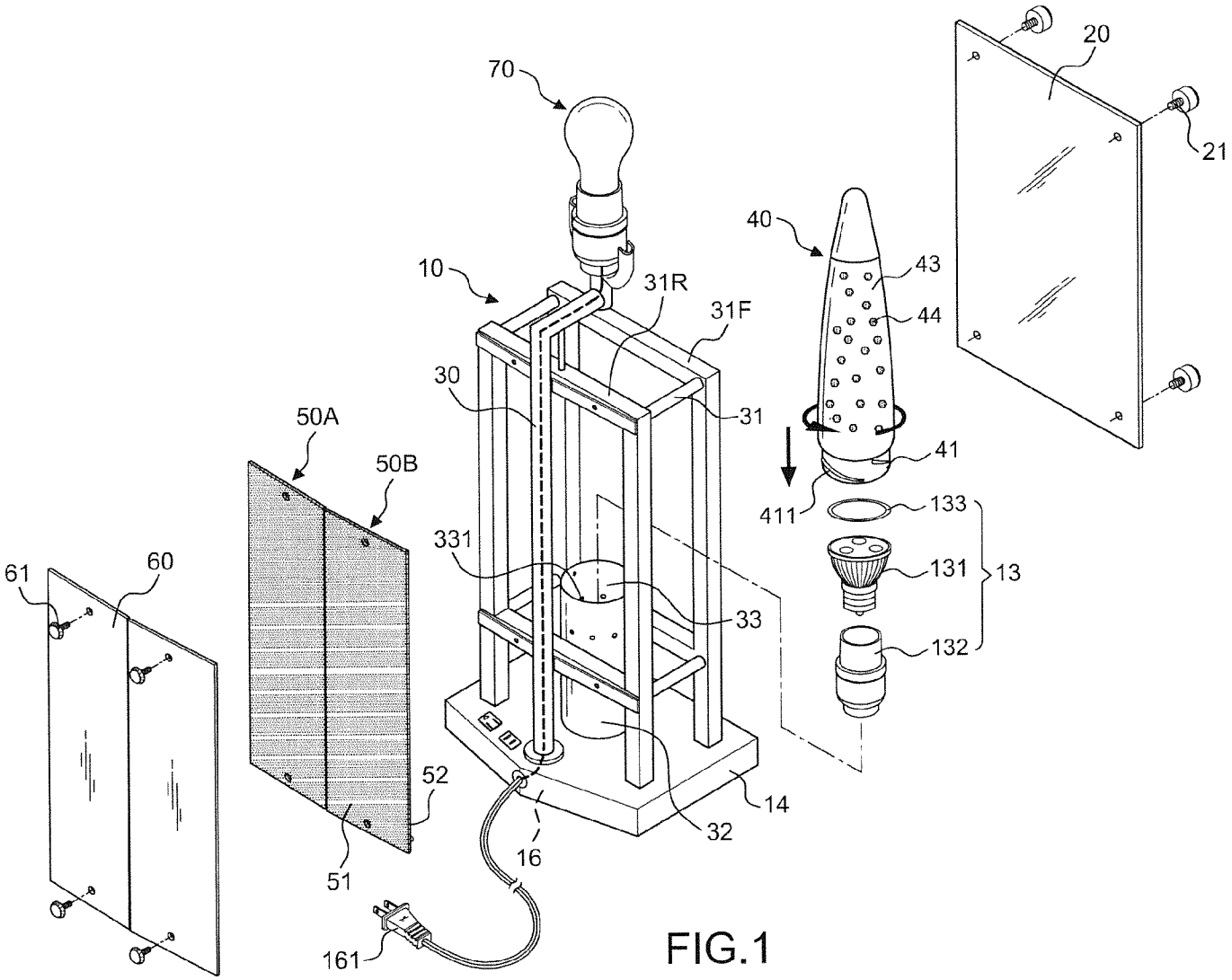
FIG. 1 is an exploded view of the present invention viewing from the back at an oblique angle.
Figure 2:
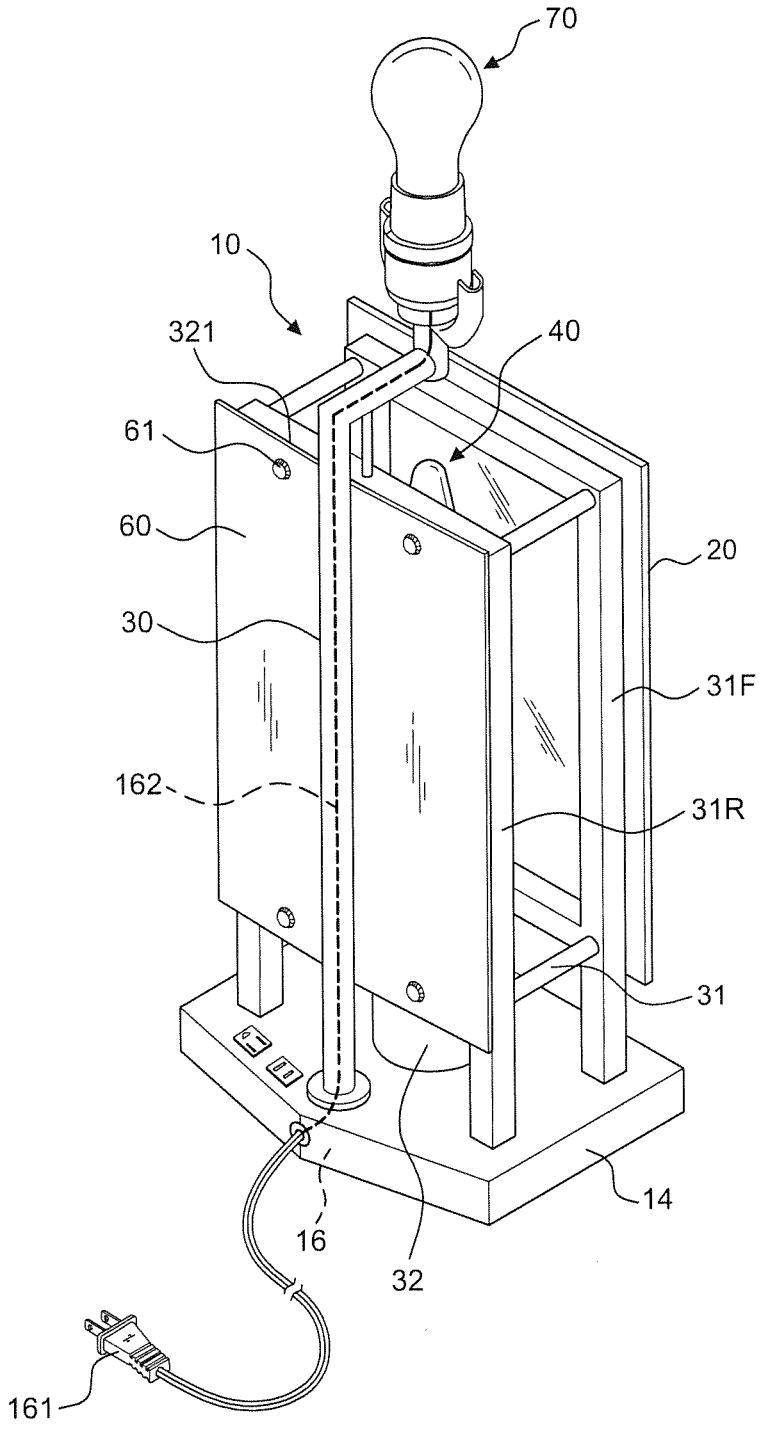
FIG. 2 is a perspective view of the present invention viewing from the back at an oblique angle.
Figure 3:
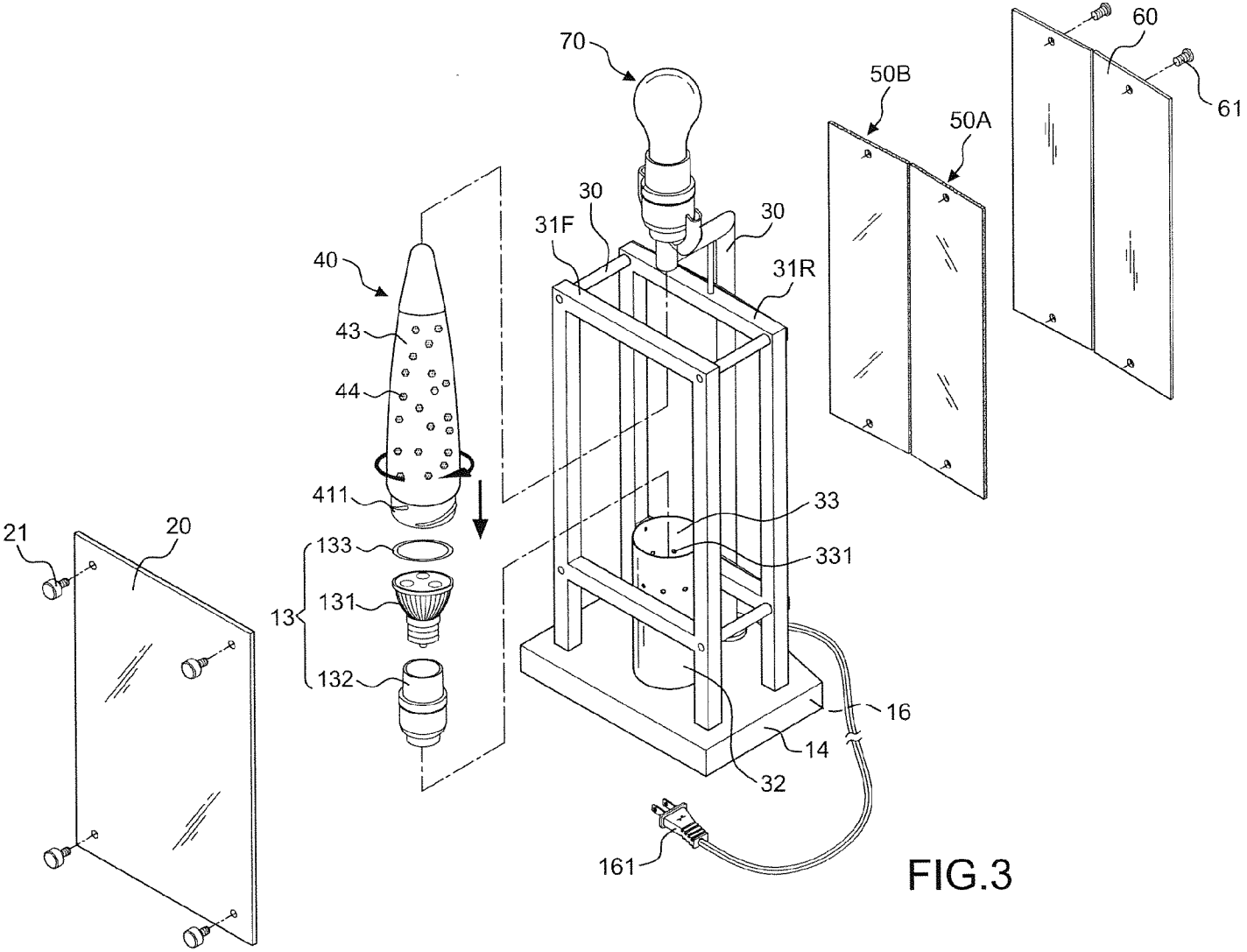
FIG. 3 is an exploded view of the present invention viewing from the front at an oblique angle.
Figure 4:
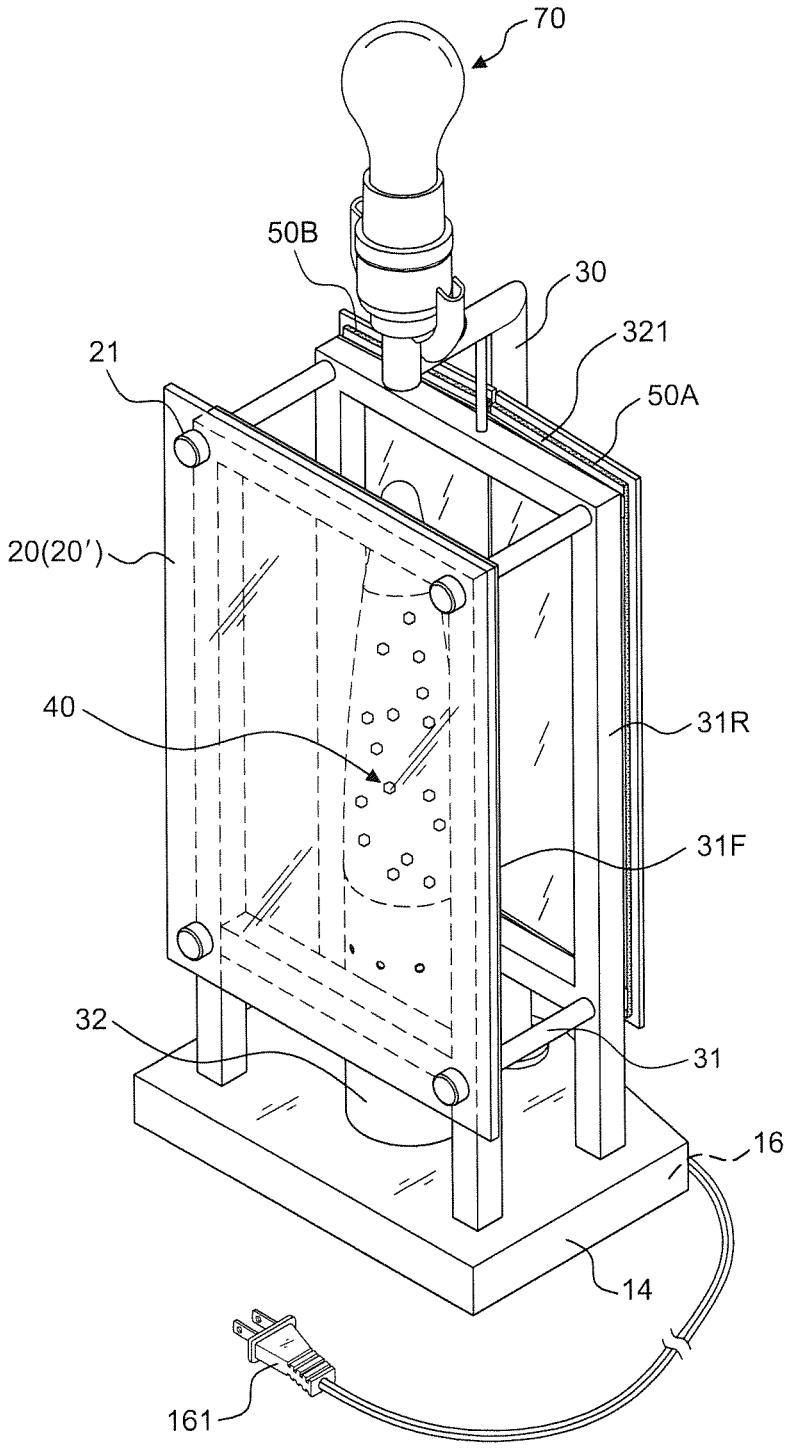
FIG. 4 is a perspective view of the present invention viewing from the front at an oblique angle.
Figure 5:
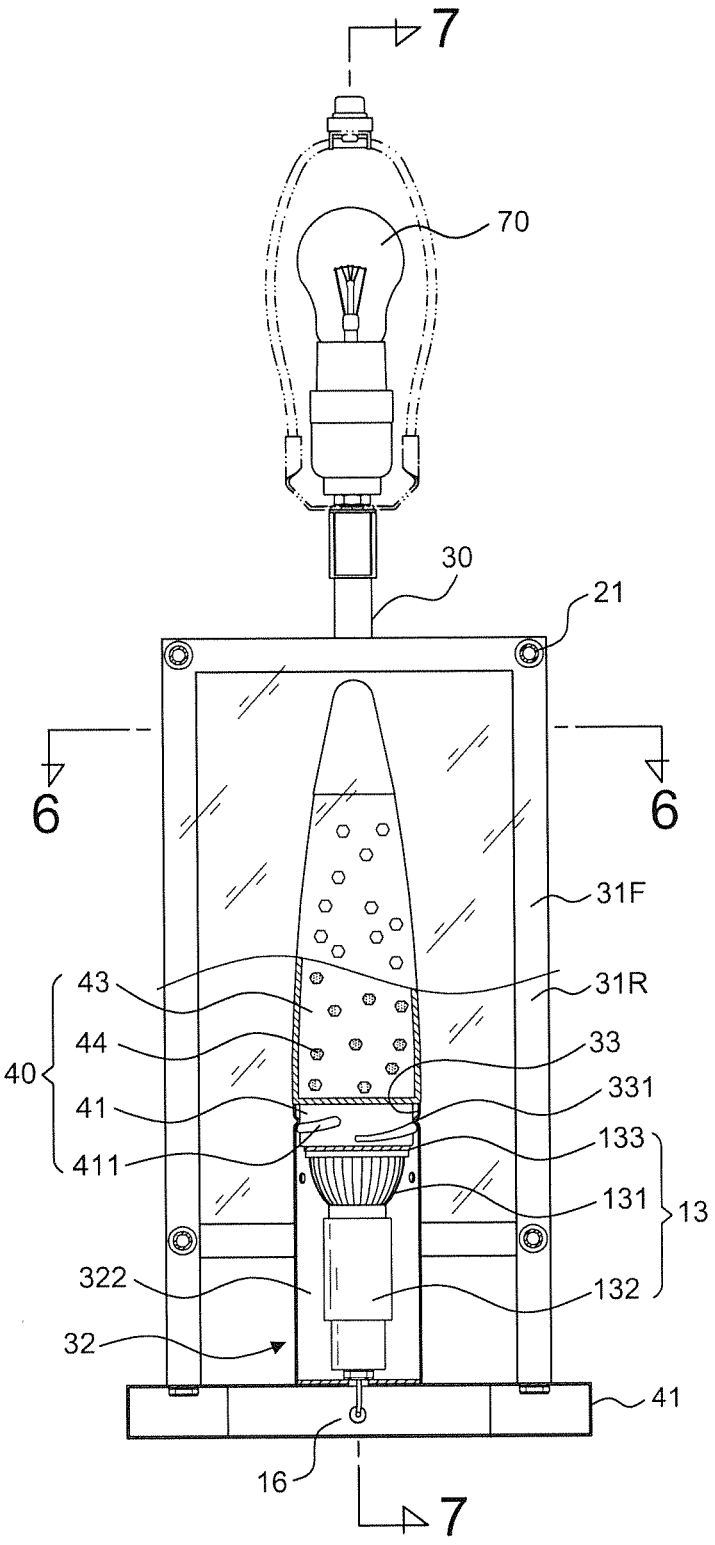
FIG. 5 is a half-section view of the present invention viewing from the front.

Referring to FIGS. 1-8, in a preferred embodiment, the present invention comprises a frame 10, a film-coated glass 20, a mounting seat 32, a projecting device 13, a support bracket 30, a transparent bottle 40, a first reflection mirror 50A, a second reflection mirror 50B and a cover plate 60.

The frame 10 includes a base 14 on which a front frame body 31F and a rear frame body 31R are arranged. The front frame body 31F and the rear frame body 31R can be assembled by a plurality of tappets 31 but are not limited to such application.

The film-coated glass 20 is mounted on the front frame body 31F by a positioning element 21 or adhesive substances and has the front side with light transmittancy facing towards the front frame body 31F as a window surface 20' and the back side with reflectivity; in other words, the visual area of the present invention is not restricted to a small window but a wide area of a window surface 20'.

The mounting seat 32 is arranged on the base 14, between the front frame body 31F and the rear frame body 31R and having a positioning hole 33 arranged thereon. On the inner periphery of the positioning hole 33 at least one positioning protrusion 331 is arranged. In the embodiment, the positioning protrusion 331 comprises a plurality of convexities but is not limited to such application; it can also be in a shape of a thread.

The projecting device 13 has at least one projecting light 131 and is disposed in an engaging room 322 under the positioning hole 33 of the mounting seat 32 with its projecting light source aiming at the positioning hole 33. In this embodiment, the positioning hole 33 and the engaging room 322 are linked up, and the projecting device 13 further includes a lamp base 132 for the projecting light 131 to be disposed thereon; the projecting light 131 can be a LED light or a bulb.

The support bracket 30 has its lower end arranged on the base 14 of the frame 10 and its upper end having a lighting source 70 arranged thereon. In this embodiment, the support bracket 30 is arranged in an L shape, but is not limited to such application.

Figure 7:
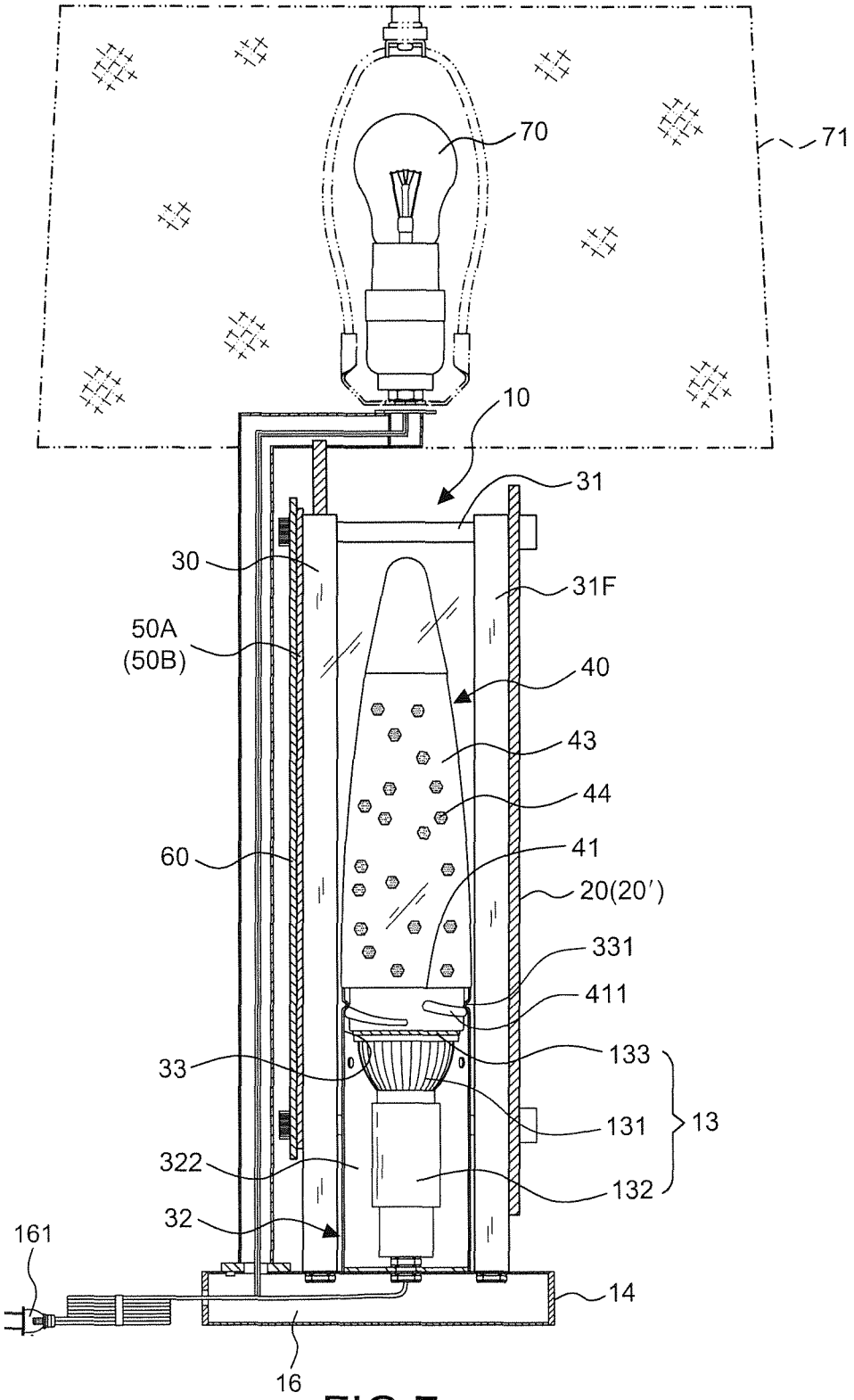
FIG. 7 is a cross-section view along line 7-7 in FIG. 5.
Figure 7A:
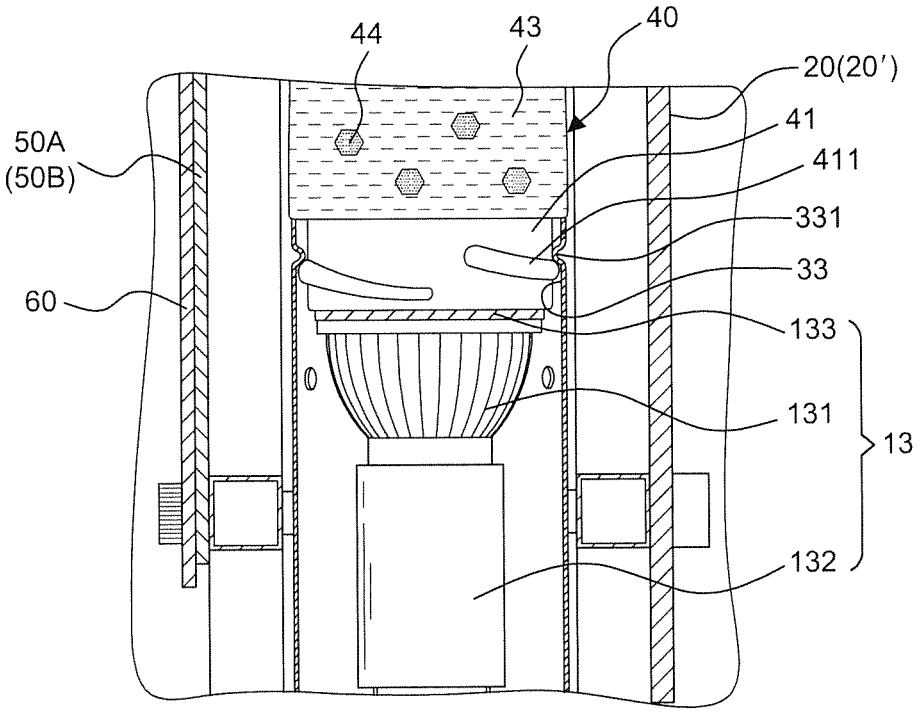
FIG. 7A is a partially enlarged sectional view of FIG. 7.
Figure 7B:
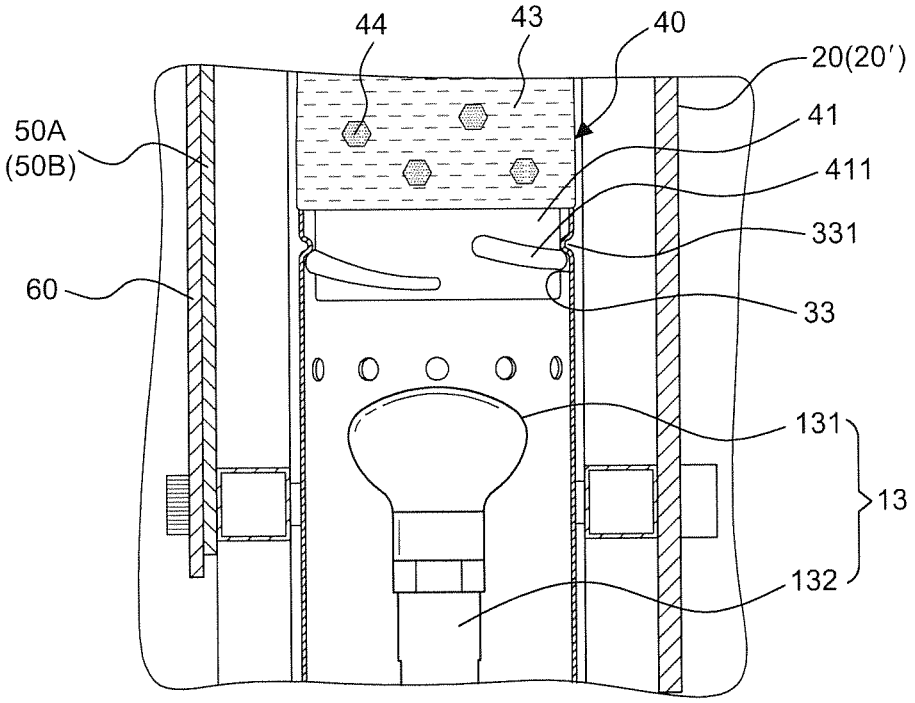
FIG. 7B is another partially enlarged sectional view of the present invention illustrating an embodiment of the projecting light.

With reference to FIGS. 7 and 7A, the transparent bottle 40 is filled with a filler 43 of liquids and the bottom 41 thereof is able to be disposed on the positioning hole 33 by spinning, and it is vertically located above the projecting device 13, corresponding to the height of the window surface 20'. The bottom of the transparent bottle 40 has at least one thread 411 on the inner periphery for a positioning protrusion 331 of the positioning hole 33 to be fixed thereon by spinning, making the transparent bottle 40 easy for assembling and maintaining. In FIG. 7A, the projecting light 131 is a LED light, and the bottom of the transparent bottle 40 has contact with the top of the LED light 131 where a heat conductive paster 132 is arranged thereon in order to conduct the heat to the transparent bottle 40. Or the projecting light 131 can be a bulb as shown in FIG. 7B. In such case, the heat conductive paster 132 is not needed since the bulb has higher watts to provide the heat for the filler 43 of liquids inside the transparent bottle 40 to flow around without the heat conductive paster 132.

Since the transparent bottle 40 needs electric power, in a preferred embodiment, the base 14 has a power supply 16 disposed inside and connected to the projecting device 13 to supply the electric power. The power supply 16 can be a transformer or an electric supplier disposed inside the base 14; connecting to an external electric wire 161 and an external transformer is also applicable. In this embodiment, the transparent bottle 40 can be a lava lamp or a glitter lamp.

The first reflection mirror 50A and a second reflection mirror 50B are fixed on the rear frame body 31R and located behind the transparent bottle 40. The back sides thereof are spread over a layer of reflector 51 and the reflection surfaces 52 thereof are facing forward; a center thereof serves as a reference to define the first and second reflection mirrors 50A, 50B symmetrically, inclined to form an angle θ between 145° and 175°, so that the window surface 20' would display an unlimited extension of an inward serial arrangement of the transparent bottle 40 from the middle after the contents thereof are reflected repeatedly and cumulatively by the first and second reflection mirrors 50A, 50B.

The cover plate 60 is disposed on the rear frame body 31R behind the first and second reflection mirrors 50A, 50B. In this embodiment, the cover plate 60 is fixed on the inclined faces 321 of the rear frame body 31R together with the first and second reflection mirrors 50A, 50B by a plurality of positioning elements 61. The cover plate 60 functions as a protection for the first and second reflection mirrors 50A, 50B. The surface area of the cover plate 60 is larger than the ones of the first and second reflection mirrors 50A, 50B, so as to protect them from external impacts.

As presented in FIG. 7, in this embodiment, the support bracket 30 is hollow for the power supply 16 to connect to an electric wire 162 through which to supply the electric power for the lighting source 70 on which a lampshade 71 is covering, making the present invention a lighting fixture.

Figure 6:
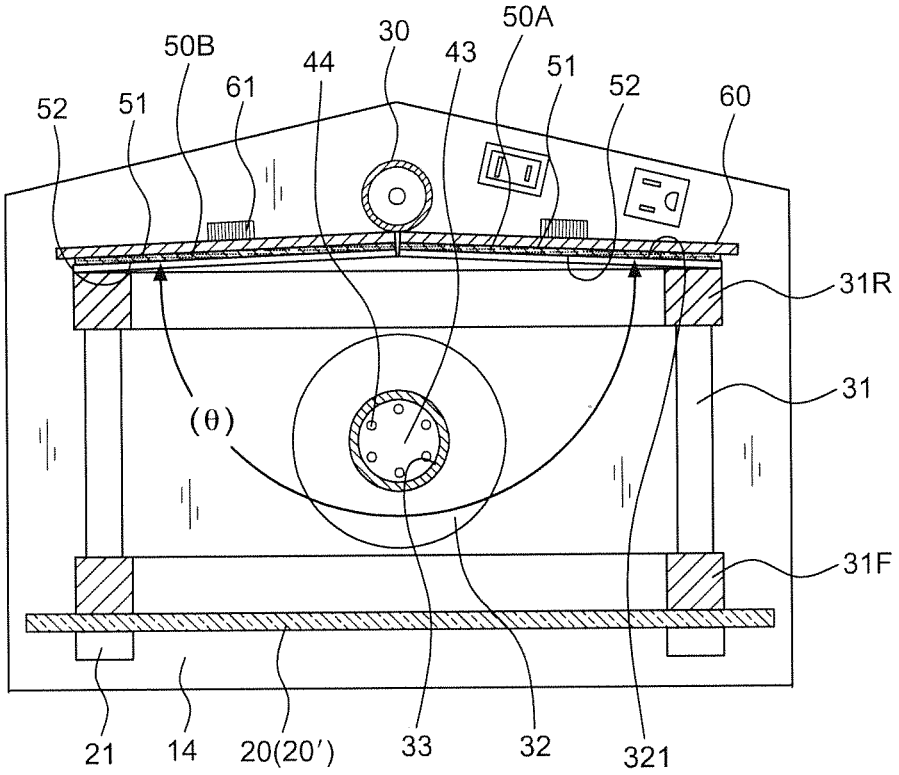
FIG. 6 is a cross-section view along line 6-6 in FIG. 5.

Moreover, referring to FIGS. 1 and 6, the first and second mirrors 50A, 50B behind the rear frame body 31R form an angle θ and have two symmetrical inclined surfaces 131 to form a pre-determined slope when they are joined together. In an applicable embodiment, the angle θ between 145° and 175° is the most preferred angle, repeatedly and cumulatively reflecting at least 6 reflections of the transparent bottle 40 and displaying an extended three-dimensional visual effect.

Figure 8:
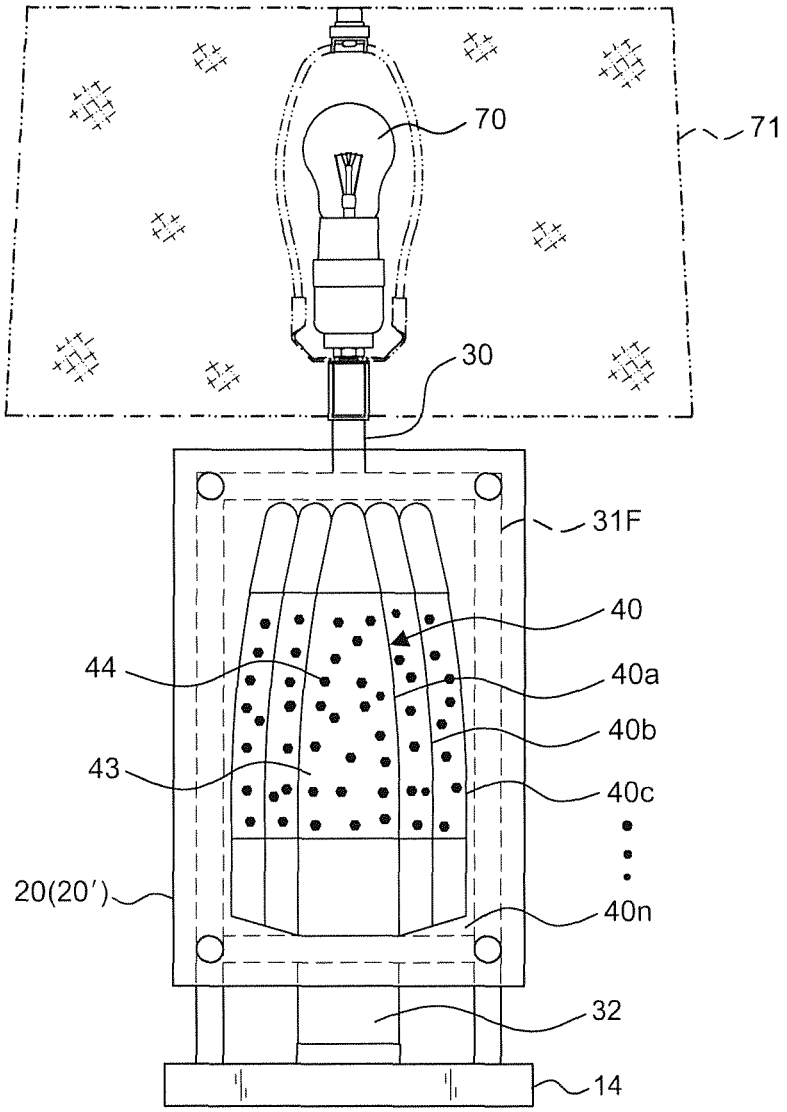
FIG. 8 is a practical application view of the present invention viewing from the front.

FIG. 8 illustrates the practical applications of the present invention. When the present invention is turned on, the transparent bottle 40 would display visual effects of flowing glitters 44. When the transparent bottle 40 is placed between the film-coated glass 20 and the first and second mirrors 50A, 50B as presented in FIG. 6, the flowing glitters 44 of the single transparent bottle 40 would be reflected repeatedly and cumulatively as shown in FIG. 8, displaying an unlimited extension of an inward serial arrangement of the transparent bottle 40 from the middle 40*a*, 40*b*, 40*c*, . . . 40*n*. The reflection is rich in visual effects instead of being a monotonous display.

With structures disclosed above, the present invention can not only display an unlimited extension of an inward serial arrangement of the transparent bottle 40 from the middle, but can further display a wider area of visual effects. Also, the transparent bottle 40 thereof is easy for assembling and maintaining.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A lighting display device comprising:

a frame including a base on which a front frame body and a rear frame body are arranged;

a film-coated glass mounted on the front frame body and having the front side with light transmittancy facing towards the front frame body as a window surface and the back side with reflectivity;

a mounting seat arranged on the base, between the front frame body and the rear frame body with a positioning hole arranged thereon, on the inner periphery of which at least one positioning protrusion is arranged;

a projecting device including at least one projecting light, disposed in an engaging room under the positioning hole of the mounting seat with a projecting light source thereof aiming at the positioning hole;

a support bracket with the lower end thereof arranged on the base of the frame and a lighting source arranged on the upper end thereof;

a transparent bottle filled with a filler of liquids with the bottom thereof being able to be fixed on the positioning hole of the mounting seat by spinning and located above the projecting device, corresponding to the height of the window surface;

a first reflection mirror and a second reflection mirror fixed on the rear frame body, located behind the transparent bottle and having the reflection surfaces thereof facing forward, and a center thereof serving as a reference to define the first and second reflection mirrors symmetrically, inclined to form an angle θ between 145° and 175°, so that the window surface would display an unlimited extension of an inward serial arrangement of the transparent bottle from the middle after the contents thereof are reflected repeatedly and cumulatively by the first and second reflection mirrors; and a cover plate disposed on the rear frame body, behind the first and second reflection mirrors.

2. The lighting display device as claimed in claim 1, wherein the first and second mirrors behind the rear frame body form an angle θ and have two symmetrical inclined surfaces to form a pre-determined slope when they are joined together.

3. The lighting display device as claimed in claim 1, wherein the projecting device further includes a lamp base for the projecting light to be arranged thereon, and the projecting light includes a LED light or a bulb.

4. The lighting display device as claimed in claim 3, wherein the projecting light is a LED light, and the bottom of the transparent bottle has contact with the top of the LED light where a heat conductive plaster is arranged thereon in order to conduct the heat to the transparent bottle.

5. The lighting display device as claimed in claim 1, wherein the base has a power supply disposed inside and connected to the projecting device to supply the electric power.

6. The lighting display device as claimed in claim 1, wherein the transparent bottle includes a lava lamp or a glitter lamp.

7. The lighting display device as claimed in claim 1, wherein the bottom of the transparent bottle has at least one thread on the inner periphery for the positioning protrusion of the positioning hole to be fixed thereon by spinning.

8. The lighting display device as claimed in claim 1, wherein the support bracket is arranged in an L shape and is hollow for the power supply to connect to an electric wire through which to supply the electric power for the lighting source on which a lampshade is covering.

* * * * *